United States Patent [19]

Barowski et al.

[11] Patent Number: 4,803,341

[45] Date of Patent: Feb. 7, 1989

[54] CORDLESS CURLING IRON WITH SEPARATE ELECTRIC HEATING STATION

[75] Inventors: Karlheinz Barowski, Hattersheim; Günter Helbig, Mörfelden-Walldorf, both of Fed. Rep. of Germany

[73] Assignee: Braun Aktiengesellschaft, Kronberg, Fed. Rep. of Germany

[21] Appl. No.: 71,280

[22] PCT Filed: Sep. 26, 1986

[86] PCT No.: PCT/DE86/00397

§ 371 Date: Jun. 19, 1987

§ 102(e) Date: Jun. 19, 1987

[87] PCT Pub. No.: WO87/02555

PCT Pub. Date: May 7, 1987

[30] Foreign Application Priority Data

Oct. 30, 1985 [DE] Fed. Rep. of Germany ..... 3538545

[51] Int. Cl.[4] ..... H05B 1/02; A45D 4/16; A45D 2/36

[52] U.S. Cl. ..... 219/222; 132/7; 132/9; 132/233; 219/225; 219/241; 219/242; 219/385; 219/495; 219/521

[58] Field of Search ..... 219/222–226, 219/230, 242, 521, 385, 495, 241; 132/7, 9, 33 R, 33 G, 37 R, 37 A, 117, 118

[56] References Cited

U.S. PATENT DOCUMENTS

| | | | |
|---|---|---|---|
| 1,917,305 | 7/1933 | Johnson | 219/242 |
| 2,584,999 | 2/1952 | Flournoy | 219/222 X |
| 3,415,254 | 12/1968 | Brock et al. | 132/33 R |
| 3,654,428 | 4/1972 | Talge et al. | 219/222 X |
| 3,665,939 | 5/1972 | Laing | 219/242 X |
| 3,881,086 | 4/1975 | Fleischhauer | 219/222 |
| 3,946,196 | 3/1976 | Waters et al. | 219/222 |
| 4,109,667 | 8/1978 | Quirk | 219/242 X |
| 4,499,355 | 2/1985 | Walter | 219/222 X |
| 4,691,095 | 9/1987 | Barowski et al. | 219/242 |

FOREIGN PATENT DOCUMENTS

| | | |
|---|---|---|
| 175232 | 3/1986 | European Pat. Off. . |
| 2039937 | 2/1971 | Fed. Rep. of Germany . |
| 1318727 | 1/1963 | France . |

*Primary Examiner*—Anthony Bartis

[57] ABSTRACT

An indirectly heatable curling iron (10) has a curling mandrel (12) inserted into the cradle (17) of an electric heating assembly (18) of a separate heating station (11) to establish an intimate thermal contact therebetween for heating the mandrel (12) to a temperature of between 100° C. and 200° C. First and second force components of relatively opposite direction act directly on the inserted curling mandrel such that the first force component, provided by a spring (21) or gravity, causes disengagement of the mandrel (12) from the heating assembly (18), while the second force component causes the mandrel (12) to intimately contact the assembly (18). The second force component is produced by magnetic interaction of a ferromagnetic body (15) on the mandrel (12) with a magnet (20) on the heating station (11), such that for temperature below an adjustable desired value, the second component exceeds the first component, while for temperature above the desired value, the first component exceeds the second component. The temperature of the heating assembly is set to a value of between 200° C. and 500° C.

7 Claims, 2 Drawing Sheets

CORDLESS CURLING IRON WITH SEPARATE ELECTRIC HEATING STATION

Figure 1A:
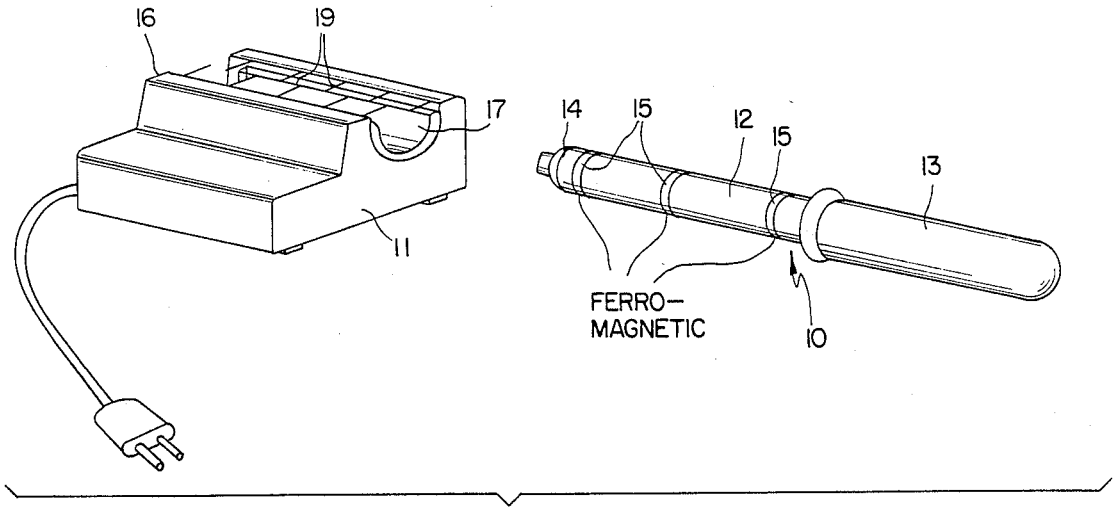

This invention relates to a cordless curling iron. From German published patent application DE-A1-31 37 545 a cordless curling iron having a separate heating station is already known in which the heating station includes a cavity for receiving a curling mandrel of the curling iron, the curling mandrel being adapted to be inserted therein during the heating cycle for establishing an intimate thermal contact. The heating assembly of the heating station is maintained at a predetermined desired temperature by means of an integrated thermostatic device. To avoid overheating of the curling iron during the heating cycle, the desired temperature of the heating assembly has to be identical with the maximum permissible heating temperature of the curling iron.

Such an adjustment of the temperature of the heating assembly is, however, disadvantageous with regard to the duration of the heating cycle of the curling iron. For rapid heating of the curling iron, it is desirable that the temperature of the heating assembly be significantly higher than the desired temperature of the curling iron.

With the exception of this restriction, this concept of an indirectly heated curling iron affords substantial advantages over conventional curling irons equipped with a direct heating assembly:

For one thing, it dispenses with the need for the normally present power cord which is generally quite awkward during the manipulation of the curling irons. For another thing, indirectly heated curling irons present no major cleaning problems since they have no electrical or mechanically delicate components. Moreover, the use of indirectly heatable curling irons positively eliminates accident hazards as they may occur, for example, when manipulating directly heatable electric curling irons in damp locations such as bathrooms, and the like.

Accordingly, it is an object of the present invention to provide an indirectly heatable curling iron with a separate heating station which allows simple and safe manipulation, is easy to clean and is characterized by a short heating cycle during which it is heated to a predeterminable operating temperature.

This object is accomplished by an indirectly heatable curling iron with a separate heating station.

The curling iron of the invention affords the advantage of a very short heating cycle and of permitting the heating temperature to be adjusted to a defined and reproducible value. By reason of the short heating cycles, the user can perform the hair styling operation swiftly without being interrupted by prolonged reheating phases. By suitable selection of the heating temperature of the curling iron which is adjustable to a defined and reproducible value, it is ensured that the curling iron heats neither to a temperature so high that it might cause damage to the hair nor to a temperature so low that it prevents the hair from being properly curled.

Further, it has proved to be an advantage to arrange magnetic retaining means in the neighborhood of at least one of the boundary areas of a heating assembly of the heating station or of the curling mandrel of the curling iron. This prevents direct heating of the ferromagnetic body whose Curie point substantially corresponds to the desired temperature of the curling iron. In an advantageous embodiment of the invention, this effect is aided by the absence of direct thermal communication between a magnet mounted on the heating assembly and the ferromagnetic body. It is thus ensured that the ferromagnetic body substantially assumes the temperature of the curling mandrel of the curling iron.

An embodiment of the invention has proved to be particularly advantageous in which the gravitational force is made use of as the first force acting in opposition to the magnetic force. The gravitational force being available "for free", it dispenses with the need for additional spring or resilient elements. This embodiment provides economy of manufacture in the implementation of the invention.

To avoid potential malfunction in the event of improper handling of the heating station, particularly when placing it with its side or top down, the special configuration of the housing of the heating station or a position-sensitive switch afford in an advantageous embodiment means preventing the heating station from being improperly positioned or from operating when in an improper position.

In accordance with a further embodiment of the invention, the first force is generated by a spring element configured either as a spiral spring or as a wire element receiving the curling mandrel of the curling iron.

Still further, it has proved to be an advantage to pivotally mount the curling iron at its head end in such a manner that the curling mandrel of the curling iron, following completion of the heating cycle, is lifted completely clear of the heating assembly of the heating station by means of at least one spring element.

An equally advantageous improvement of the invention provides for the arrangement of several ferromagnetic bodies of different Curie points along the length of the curling mandrel. The depth of insertion of the curling mandrel into the heating station being variable, the curling mandrel can be set to different desired temperatures which is accomplished by having ferromagnetic bodies of different Curie points register with the magnets provided in the heating assembly, in dependence upon the insertion depth chosen. By these means, it is possible, for example, to adjust the desired temperature of the mandrel to accommodate different degrees of dampness or types of hair.

Figure 1B:
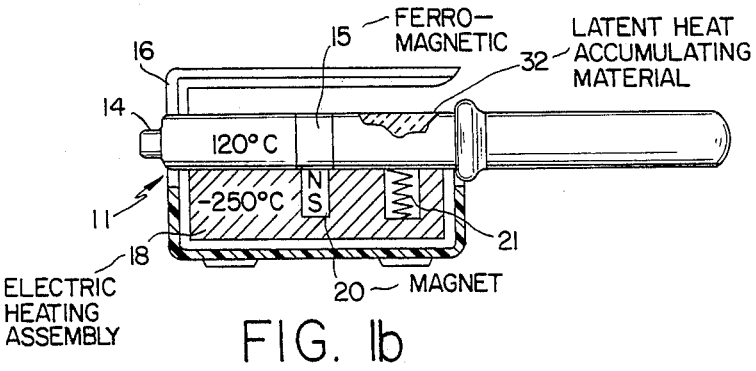
Figure 1C:
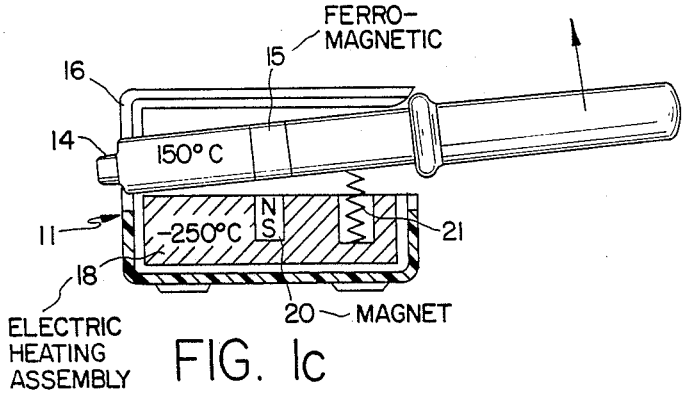
Figures 2, 3:
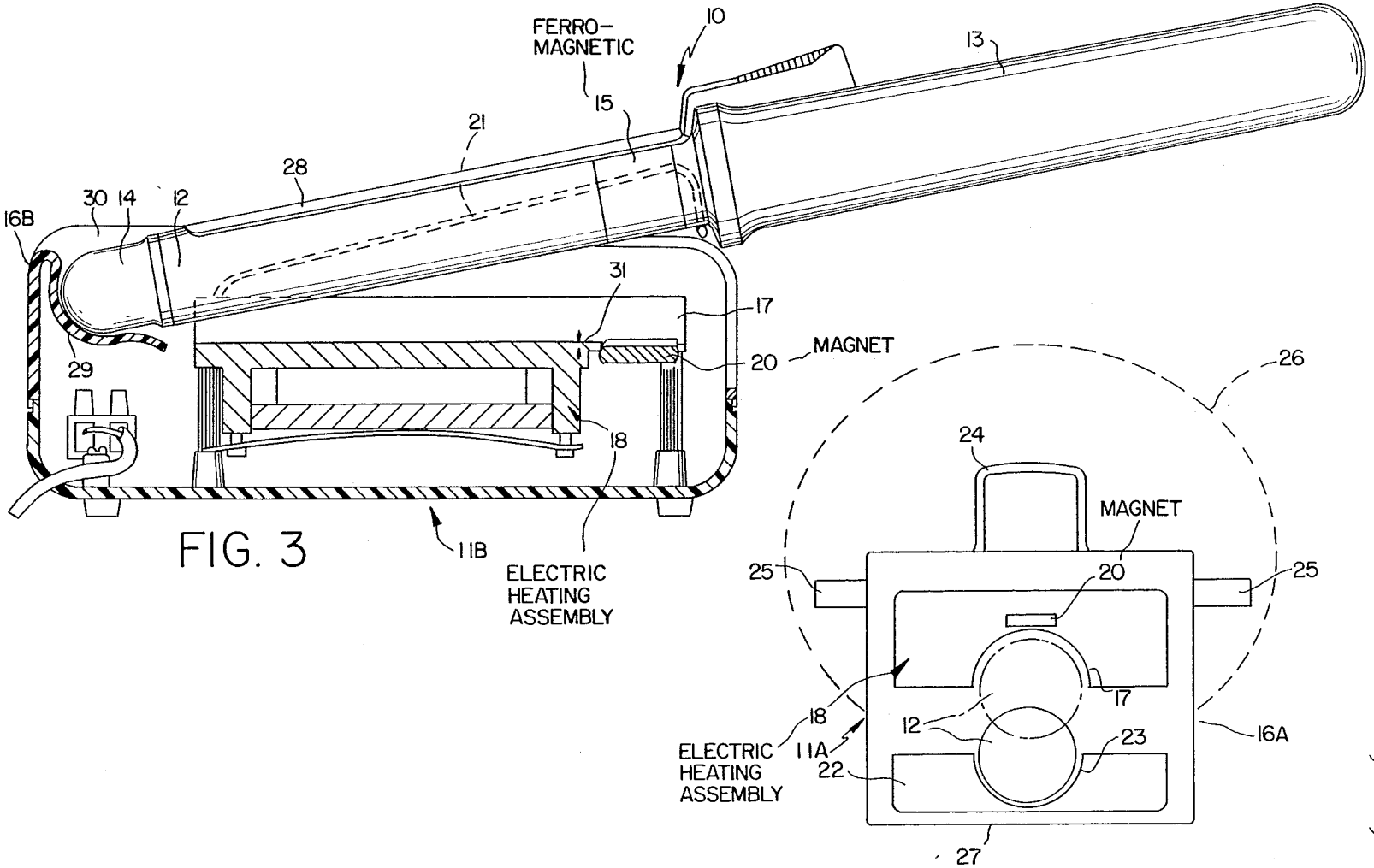

Further advantages of the invention will become apparent from the subsequent description of embodiments in conjunction with the accompanying drawings, in which:

FIG. 1*a* is a view of the curling iron of the invention illustrating one embodiment thereof;

FIG. 1*b* is a view of the curling iron showing it in the position it assumes during the heating cycle prior to reaching the desired temperature;

FIG. 1*c* is a view of the curling iron showing it in the position it assumes following completion of the heating cycle, that is, after the desired temperature has been reached;

FIG. 2 is a view of a further embodiment of the curling iron of the invention utilizing the gravitational force as a further force; and FIG. 3 is a view of a third embodiment of the curling iron of the invention utilizing as a further force the spring force of a wire element receiving the curling mandrel of the curling iron.

Referring now to FIG. 1*a* of the drawings, there is shown a first embodiment of an indirectly heated curling iron 10 having a separate heating station 11. The curling iron 10 is comprised of a curling mandrel 12 and a handle portion 13 in the known manner. Secured to the head end of the curling mandrel 12 is a protection cap 14 which is made of a material of low thermal conductivity and, accordingly, heats only insignificantly. The curling mandrel 12 is fabricated of a heat-retaining material and is loaded, in its entirety or partly, with a magnetic material changing its magnetic properties in dependence upon temperature (Thermoflux, for example). In the embodiment of FIG. 1*b*, the curling mandrel 12 has in its center area a ring 15 made of such a magnetic material. However, as indicated in FIG. 1*a*, it will be appreciated that several rings 15 of this type may be fitted on the curling mandrel 12. Preferably, at least one ring 15 is arranged in either of the end areas of the curling mandrel 12.

The heating station 11 is comprised of a housing 16 having a recess dimensioned for insertion of the curling mandrel 12. The housing 16 accommodates a heating assembly 18 shown schematically in FIGS. 1*b*, 1*c* and incorporating a cavity 17, the heating assembly being heated by means of resistance heating using a thermostat, a PTC resistance heating element, or the like. It is to be understood that the present invention is not limited exclusively to mainspowered, that is, electrical, heating stations, but is also suitable for use in gas-heated heating stations, for example. Accidental contact with the heating assembly 18 can be avoided by the provision of a pivoted screen 19 covering the recess of the housing 16 and the cradle 17, or similar guard means.

As becomes apparent from FIGS. 1*b*, 1*c*, the heating assembly 18 incorporates at least one permanent magnet 20 and a spring element 21. The permanent magnet 20 is positioned in the heating assembly in such a manner that it will register with the ring 15 provided on the curling mandrel 12 of the curling iron 10 as soon as the curling mandrel 12 is properly inserted into the cavity 17 of the heating station 11. For curling iron temperatures below a predetermined desired value, the magnetic properties of the ring 15 will be normal so that with the respective poles of the ring 15 and the permanent magnet 20 suitably oriented, an attractive force occurs between the curling mandrel 12 and the heating assembly 18. This magnetic force predominates over the force of the spring element 21 which in the present embodiment is configured as a spiral spring acting in substantially opposite direction, that is, as a repulsive force. As a result, the predominant attractive magnetic force causes the curling mandrel 12 to be in intimate thermal communication with the heating assembly 18 of the heating station 11, which is preferably operated at heating temperatures in the range of between 200° C. and 500° C., in particular in the range of between 250° C. and 350° C. In consequence, the curling iron 10 heats rapidly. The temperature of the heating assembly 18 changes only insignificantly during the heating cycle since the heat output of the heating assembly 18 can be adjusted by means of a temperature control to meet the individual requirements.

The magnetic properties of the material of the ring 15 determine the desired temperature of the curling mandrel 12 of the curling iron 10. As the temperature of the ring material approaches the Curie point, the permeability of the ring material will become less. This causes a reduction in the magnetic retaining forces between the curling mandrel 12 and the heating assembly 18, so that eventually the influence of the repulsive spring force of the spring element 21 will prevail, causing the curling mandrel 12 to be unseated from the heating assembly 18, thereby completing the heating cycle.

The curling iron 10 is thus ready for use and may be used for hair styling operations for a prolonged period of time. By suitable selection of the ring material, the desired temperature of the curling mandrel 12 is preferably set in the range of between 100° C. and 200° C., particularly to about 150° C., whilst the temperature of the heating assembly 18 is set to a value exceeding this value by, in particular, 100° C. to 200° C., approximately. By these means, very rapid heating of the curling iron 10 is ensured. In addition, the curling iron 10 is of simple construction, can be cleaned readily and has a very high operational safety because it dispenses with the need for electrical or mechanically delicate components.

FIG. 2 shows another embodiment of the invention in schematic form. It is a front elevation of the heating station 11A showing the curling mandrel 12 inserted for being heated. In contrast to the embodiment of FIG. 1, the heating assembly 18 is arranged in the upper section of the housing 16A of the heating station 11A. The curling mandrel 12 of the curling iron 10 is held suspended in the corresponding cavity 17 of the heating assembly 18. The retaining forces are produced by the magnetic effect between at least one permanent magnet 20 in the heating assembly 18 and the magnetic material with which the curling mandrel 12 is loaded. The component of force acting substantially in opposition to these magnetic forces results from the gravitational force.

With the permeability of the magnetic material with which the curling mandrel 12 is loaded decreasing as the temperature increases, as already described in detail, the curling iron 10, after having reached the desired temperature, will simply drop off the heating assembly 18 down onto a bearing means 22 preferably fabricated of a heat-resistant and thermally insulating material, the bearing means 22 of the present embodiment having a cavity 23 for receiving the curling mandrel 12 of the curling iron 10. This embodiment obviates completely the need for spring elements for unseating the curling mandrel 12 from the heating assembly 18. However, means have to be provided to ensure that the heating station 11 cannot be operated when in an improper position. An improper position exists particularly if the heating station 11 is placed with its side or top down, because then the components of the repulsive or attractive forces are in either parallel or vertical relative orientation precluding in the extreme case unseating of the curling mandrel 12 from the heating assembly 18. Such improper handling may be obviated by providing the housing 16A of the heating station 11 with a suitable structure. FIG. 2 represents some possibilities to illustrate this by way of example, showing the provision of a handle 24 on the top or of a lug 25 on either side wall of the housing 16A. It would also be conceivable to provide the upper part of the housing 16A with a part-cylindrical configuration as indicated by the dashed line 26. If, in addition, arrangements are made to the effect that the center of gravity of the heating station 11A comes to lie between the center axis of the part cylinder and a base plate 27 of the housing 16A with the curling iron 10 in inserted position, improper positioning of the housing 16A is rendered impossible because it would result in an unstable position.

If, for reasons of a more aesthetically pleasing appearance, such a practical configuration of the housing 16A does not come to bear, the added possibility exists to provide a position-sensitive electric switch interrupting the heating circuit to the heating assembly 18 if the heating station 11A is not properly placed with its base plate 27 down.

FIG. 3 illustrates in detail a further embodiment of the curling iron of the invention. For reasons of clarity, the heating station 11B is shown in longitudinal section, with the curling mandrel 12 in inserted yet lifted position. The curling iron 10 which in the example shown is equipped with a curl forming blade 28 has its protection cap 14 pivotally mounted in a shoulder 29 formed in the interior of the housing 16B. To secure the curling iron 10 in the heating station 11B, a bar 30 is provided above the shoulder 29 to engage the protection cap 14 of the inserted curling iron 10. A spring element 21 approximately adapted to the rim contours of a half shell engaging the curling mandrel 12 is secured to the heating station 11 in the region of the cap 14 of the inserted curling iron 10 and engages about half the circumference of the curling mandrel 12 in the area where it blends into the handle portion 13, the spring element producing the component of force causing disengagement of the curling mandrel 12 from the heating station 18. The height of the shoulder 29 relative to the cavity 17 of the heating assembly 18 is determined such that the curling mandrel 12, when unseated, is at no point over its entire length in direct thermal communication with the heating assembly 18.

The magnetic force is produced by means of a ring 15 arranged in the proximity of the handle of the curling mandrel 12 or by some other means of introducing the magnetic material, and by the magnet 20 provided in the heating assembly 18. In an advantageous embodiment of the invention, the magnet 20 is slightly embedded in the cavity 17 of the heating assembly 18 so that a spacing, identified by arrows 31, is maintained between the ring 15 on the curling mandrel 12 and the magnet 20 also with the curling iron 10 inserted into the cavity 17 for being heated. By these means, direct heating of the ring 15 by way of the heating assembly 18 and the magnet 20 acting as heat carrier can be accomplished without substantial reduction in the effect of the magnetic force. It is thereby ensured that the temperature of the ring is essentially determined by the temperature of the curling mandrel 12 and not by the temperature of the heating assembly 18.

The bar 30 provided above the shoulder 29 serves the purpose of ensuring a good thermal communication between the curling mandrel 12 and the heating assembly 18. Accordingly, the bar 30 is arranged at such a height relative to the protection cap 14 of the inserted curling iron 10 that it prevents the front part of the curling mandrel 12 from unseating itself during the heating cycle.

The mode of operation of this arrangement of FIG. 3 corresponds substantially to that of FIG. 1.

The amount of lift of the curling mandrel 12 following completion of the heating cycle, which lift is determined by the spring constant of the spring element 21, is advantageously fixed in such a manner that the heat of the curling mandrel is balanced in the unseated condition. This means that the heat loss from the lifted curling mandrel 12 to its surroundings corresponds substantially to the amount of heat received by the curling mandrel 12 indirectly, that is, through the cushion of air between the heating assembly 18 and the curling mandrel 12. By these means, the temperature of the curling mandrel 12 is maintained constant also if it remains unseated in the heating station 11B for a prolonged period of time. The individually adjustable height is determined by the individual application and has to be established by those skilled in the art on a case-by-case basis.

It is to be understood that further embodiments are possible in addition to the embodiments described herein in detail. For example, it has proven advantageous to fabricate the curling mandrel 12 of metal, preferably aluminum. Also, configuring the curling mandrel 12 as a latent heat accumulator using a heat retaining material 32 such as wax, salt solution or the like may be suitable for extending the period of use of the curling iron 10.

To operate the heating station 11 independent of an electrical supply, the invention may be further developed by utilizing, for example, the combustion heat occurring in the catalytic combustion of a gaseous fuel for heating purposes.

Furthermore, a particularly advantageous embodiment of the invention resides in the use of two or more curling irons in combination with a single heating station so that, by alternately heating the different curling irons, a curling iron heated to the desired or operating temperature is at all times available for use.

A still further particularly advantageous embodiment of the invention provides for the arrangement of at least two ferromagnetic bodies 15 of different Curie points on the curling mandrel 12 of the curling iron 10, as shown in FIG. 1*a*. By reason of a user-selectable insertion depth of the curling mandrel 12 into the heating assembly 18, the possibility exists to have at least one of the ferromagnetic bodies of different Curie points register with the permanent magnet 20. This enables the desired temperature of the curling mandrel 12 to be selected within a wide range, so that this temperature is user-adjustable to accommodate different hair conditions.

We claim:

1. An indirectly heatable curling iron and heating station comprising a curling iron (10) having an elongated curling mandrel (12), a separate heating station (11) which includes a heating assembly (18) having a cradle (17) for removably receiving said curling mandrel (12) of the curling iron for heating the mandrel (12) to a desired temperature prior to use, said cradle (17) providing direct intimate thermal contact between said mandrel (12) and the heating assembly when the mandrel (12) is inserted therein, said curling iron (10) and heating station (11) including means for producing first and second force components of relatively opposite direction and acting upon said mandrel (12) of the curling iron (10) when inserted into the cradle (17) of the heating assembly (18) of the heating station (11), such that the first force component causes disengagement of the curling mandrel (12) from the heating assembly (18) to break intimate thermal contact therebetween while the second force component causes the curling mandrel (12) to engage the heating assembly (18) to establish said intimate thermal contact, said means for producing the second component of force comprising a permanent magnet (20) arranged in the lateral boundary area of the cradle (17) of the heating assembly (18) and a ferromagnetic body (15) arranged on the curling mandrel (12) of the curling iron (10), the Curie point of the ferromagnetic body (15) corresponding substantially to the desired temperature of the curling mandrel (12), said permanent magnet being embedded in a recess of said heating station (11) and said permanent magnet (20) and said ferromagnetic body (15) lying opposite each other when the curling mandrel (12) is inserted into the cradle (17) of the heating assembly, such that no direct contact exists between said permanent magnet and said ferromagnetic body (15), the second force component varying in dependence upon the temperature of the curling mandrel (12), such that for temperatures of the curling mandrel (12), below a selected desired value, the value of the second force component exceeds the value of the first force component, while for temperatures of the curling mandrel (12) above the adjustable desired value, the value of the first force component exceeds the value of the second force component, and that the temperature of the heating assembly (18) is set to a value above the desired temperature of the curling mandrel.

2. A curling iron and heating station as claimed in claim 1, characterized in that the ferromagnetic body (15) is configured as at least one ring embracing the curling mandrel (12).

3. A curling iron and heating station as claimed in claim 1, characterized in that the spring force of a spring element (21) acting between the heating assembly (18) and the curling mandrel (12) is utilized as the first component of force, said spring element (21) being a wire element for receiving the curling mandrel (12) of the curling iron (10) and being secured to the heating station (11) above the heating assembly (18).

4. A curling iron and heating station as claimed in claim 1 or 3, characterized in that said housing has a shoulder (29) and a protection cap (14) is provided at one end of the curling iron (10), said protection cap being pivotally mounted in said shoulder (29) when the curling mandrel is inserted into the cradle of the heating assembly, said shoulder (29) being arranged relative to the heating assembly (18) in such a manner that the curling mandrel (12), following its disengagement from the heating assembly (18) as caused by the first component of force, has no direct thermal contact with the heating assembly (18).

5. A curling iron as claimed in claim 1, characterized in that the curling mandrel (12) is fabricated at least in part of materials with latent heating accumulating properties.

6. A curling iron and heating station as claimed in claim 1, characterized in that the heating assembly (18) of the heating station (11) has an operating temperature in the range of between 200° C. and 500° C.

7. A curling iron and heating station as claimed in claim 1, characterized in that the desired temperature of the curling mandrel (12), by way of the material properties of the ferromagnetic material, is set to values in the range of between 100° C. and 200° C.

* * * * *